US009321063B2

(12) United States Patent
Schmuck

(10) Patent No.: US 9,321,063 B2
(45) Date of Patent: Apr. 26, 2016

(54) METHOD FOR OPERATING A DOSING FEEDER FOR A VISCOUS MEDIUM

(71) Applicant: GM GLOBAL TECHNOLOGY OPERATIONS LLC, Detroit, MI (US)

(72) Inventor: Otmar Schmuck, Grosse-Gerau (DE)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 0 days.

(21) Appl. No.: 14/477,660

(22) Filed: Sep. 4, 2014

(65) Prior Publication Data

US 2015/0060483 A1 Mar. 5, 2015

(30) Foreign Application Priority Data

Sep. 5, 2013 (DE) ..... 10 2013 014 706

(51) Int. Cl.

| | |
|---|---|
| ***B67B 7/00*** | (2006.01) |
| ***B05B 11/00*** | (2006.01) |
| ***B05C 11/10*** | (2006.01) |
| ***B05C 17/015*** | (2006.01) |

(52) U.S. Cl.

CPC ..... *B05B 11/0097* (2013.01); *B05B 11/30* (2013.01); *B05C 11/10* (2013.01); *B05C 17/015* (2013.01)

(58) Field of Classification Search

CPC .... B05B 11/0097; B05B 11/30; B05C 11/10; B05C 17/015

USPC ..... 222/1, 54, 55, 63, 135, 137, 146.5, 504, 222/325–327; 118/667, 692, 693

See application file for complete search history.

(56) References Cited

U.S. PATENT DOCUMENTS

| | | | | |
|---|---|---|---|---|
| 3,570,725 | A | 3/1971 | Baker et al. | |
| 5,524,797 | A * | 6/1996 | Schultz, Sr. | 222/334 |
| 5,795,390 | A | 8/1998 | Cavallaro | |
| 5,803,320 | A * | 9/1998 | Cutting et al. | 222/641 |
| 6,450,369 | B1 * | 9/2002 | Heyes | 222/129.1 |
| 7,111,757 | B1 * | 9/2006 | O'Brien et al. | 222/71 |
| 2003/0084845 | A1 * | 5/2003 | Prentice et al. | 118/679 |
| 2003/0132243 | A1 * | 7/2003 | Engel | 222/61 |
| 2005/0252934 | A1 * | 11/2005 | Miller et al. | 222/135 |
| 2008/0029541 | A1 * | 2/2008 | Wallace et al. | 222/129.3 |
| 2014/0209630 | A1 * | 7/2014 | O'Leary et al. | 222/23 |

FOREIGN PATENT DOCUMENTS

| | | | |
|---|---|---|---|
| DE | 3929608 | A1 | 3/1990 |
| DE | 69600973 | T2 | 4/1999 |
| DE | 10003384 | A1 | 8/2001 |
| DE | 202006004780 | U1 | 8/2006 |
| EP | 0983800 | A2 | 3/2000 |
| EP | 1375008 | A2 | 1/2004 |
| WO | 2006128561 | A1 | 12/2006 |

* cited by examiner

*Primary Examiner* — Lien Ngo

(74) *Attorney, Agent, or Firm* — Ingrassia Fisher & Lorenz PC

(57) ABSTRACT

A method for a dosing feeder for a viscous medium is disclosed. When the dosing feeder is operated in a system mode, the medium is supplied by means of a pump from a storage container to the dosing feeder. A controller is used to supply the medium to the dosing feeder and dispense the medium from the dosing feeder. When the dosing feeder is operated in a cartridge operating mode, the medium is supplied from the storage container to the dosing feeder separately from a cartridge to the dosing feeder. The controller is used to supply the medium to the dosing feeder and dispense the medium from the dosing feeder.

7 Claims, 2 Drawing Sheets

METHOD FOR OPERATING A DOSING FEEDER FOR A VISCOUS MEDIUM

CROSS REFERENCE TO RELATED APPLICATION

This application claims priority to German Patent Application No. 102013014706.9 filed Sep. 5, 2013 which is incorporated herein by reference in its entirety.

TECHNICAL FIELD

The technical field relates to a method for operating a dosing feeder for a viscous medium. In particular, this viscous medium involves an adhesive or sealant.

BACKGROUND

In the automotive industry, the various components are increasingly being joined together by means of adhesives. Sealants are also seeing increasing use in the manufacture of automobiles. These viscous media are supplied to a dosing feeder, and from there applied to the component to be adhesively bonded or sealed.

There are systems in use where the viscous medium is supplied to the dosing feeder from a storage container by means of a pump, and a controller is used to supply the viscous medium to the dosing feeder and dispense the medium from the dosing feeder.

This type of system operating mode makes sense for continuous production, since the viscous medium is uninterruptedly processed. By contrast, if the viscous mass is not continuously processed, the problem becomes that the viscous medium hardens, so that the system can no longer be operated. Apart from that, this system operating mode is not suitable for applying small quantities of a viscous medium, in particular if the medium is to be applied only to a relatively small number of components, as is required for small numbers or when testing new viscous media, meaning in particular new adhesives or sealants.

For example, EP 1 375 008 A2 discloses a method for adhesively bonding automotive components, e.g., for flange weld bonds in body construction, using an adhesive that is a multi-part adhesive. Use is here made of a dosing feeder, to which the adhesive is supplied from a storage container by means of a pump.

SUMMARY

The present disclosure further develops a method for operating a dosing feeder for a viscous medium in such a way that the dosing feeder can also be operated without filling the system with the viscous medium. The method according to the present disclosure provides for a dosing feeder that operates in the cartridge mode. As a consequence, the entire system is not operated based on any system operating mode, with the method for operating the dosing feeder instead being implemented in the cartridge operating mode. In this cartridge operating mode of the dosing feeder, the medium is separately supplied from the storage container to the dosing feeder. The medium is supplied to the dosing feeder from a cartridge. The medium is supplied to the dosing feeder and the medium is dispensed from the dosing feeder by means of the controller, meaning by means of the controller provided for the method of operating the dosing feeder in the system operating mode.

As a consequence, the dosing feeder is filled by means of the cartridge, without having to fill the system, meaning the original system, with a viscous medium, in particular an adhesive or sealant. In particular, the cartridge is designed as a pneumatic hand cartridge gun.

Since instead of operating in the system mode, the dosing feeder can now operate in the cartridge mode, the method according to the present disclosure can already validate applications of viscous media, in particular validate an adhesive application, early on in the project, since the original system does not have to be filled. It is especially important that this application can take place with the original dosing system and with original parameters, since the dosing feeder controller is identical, regardless of whether in the system operating mode or cartridge operating mode.

Another advantage to the method according to the present disclosure lies in the fact that, because the dosing feeder can be operated in the cartridge mode, a savings of material can be realized in the commissioning process. Furthermore, new viscous media, in particular new adhesives or sealants, can be easily tested in production. The conversion from the system operating mode to the cartridge operating mode can take place within a short period of time, for example within 10 minutes. All that must be done is to interrupt the pump controller and medium supplied by the pump, mount the cartridge, in particular in the area of a dosing feeder adapter for the medium supplied by means of the pump, and connect the cartridge with the controller.

Beyond that, operating the dosing feeder in the cartridge mode represents a cost-effective alternative, since it only requires providing the cartridge with its controller. The filling process is initiated by the controller on the system side in the cartridge operating mode, just as in the system operating mode.

The cartridge in the cartridge operating mode of the dosing feeder and a line leading from the storage container to the dosing feeder in the system operating mode are preferably connected with the same access of the dosing feeder. As a consequence, the viscous medium is supplied to the dosing feeder regardless of the mode in which the dosing feeder is operated—system or cartridge.

In particular, a parallel connection is established between a pneumatic valve of the cartridge that regulates the dispensing of medium from the cartridge in the cartridge operating mode and a pneumatic valve of the dosing feeder that regulates the dispensing of medium from the dosing feeder in the system operating mode. This makes it possible to implement the method for operating the dosing feeder at a minimal structural and control outlay.

In the system operating mode, the controller preferably actuates the pump for conveying the medium from the storage container to the dosing feeder. The control process is preferably configured in such a way that a robot controller uses a field bus to control a dispensing controller, with the dispensing controller further controlling the pump, dosing feeder and cartridge. A control line of the controller is preferably connected by way of a Y-distributor with the dosing feeder and cartridge in the cartridge operating mode. A pneumatic line is preferably connected by way of a Y-distributor with the dosing feeder and cartridge.

BRIEF DESCRIPTION OF THE DRAWINGS

The present disclosure will hereinafter be described in conjunction with the following drawing figures, wherein like numerals denote like elements.

DETAILED DESCRIPTION

The following detailed description is merely exemplary in nature and is not intended to limit the present disclosure or the application and uses of the present disclosure. Furthermore, there is no intention to be bound by any theory presented in the preceding background or the following detailed description.

Figure 1:
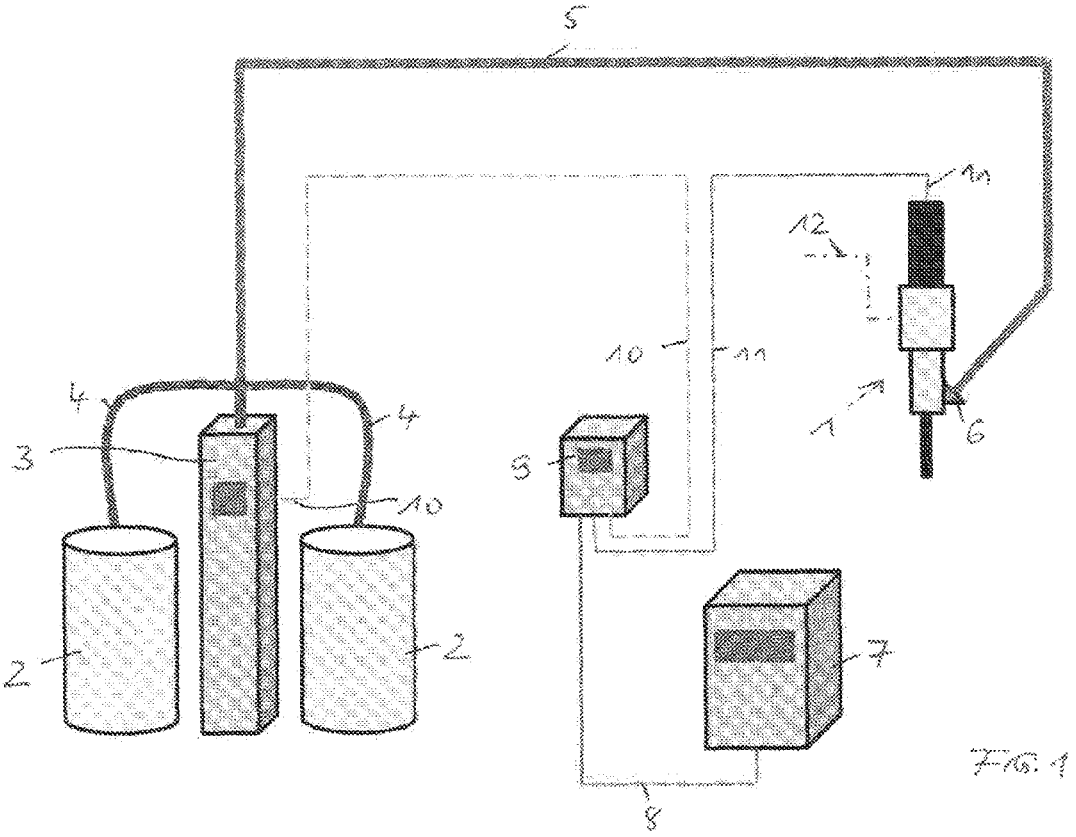
FIG. 1 Prior Art
FIG. 1 is a diagrammatic view of a system for operating a dosing feeder for a viscous medium in a system mode according to prior art.

FIG. 1 illustrates a system according to prior art for operating a dosing feeder 1 for a viscous medium in the system mode. This viscous medium preferably involves an adhesive or sealant. The system exhibits two storage containers 2 for holding the viscous medium, along with a pump 3 to convey the medium from the respective storage container 2 to the dosing feeder 1. Lines 4 lead from the storage containers 2 to the pump 3, and one line 5 leads from the pump 3 to the dosing feeder 1. As a consequence, the lines 4 and 5 convey the medium from the respective storage container 2 via the pump 3 to the dosing feeder 1. The dosing feeder 1 is provided with an adapter 6, with which the line 5 is connected. The adapter 6 thus establishes the access to the dosing feeder 1.

Provided to actuate the dosing feeder 1 and pump 3 is a robot controller 7, which is connected by way of a field bus 8 with a dispensing controller 9. A control cable 10 connects the dispensing controller 9 with the pump 3, while a control cable 11 connects the dispensing controller 9 with the dosing feeder 1. The control cable 11 consists of a 24 V-connection for driving an actuator of the dosing feeder 1, and if necessary a heating device of the dosing feeder 1. The dosing feeder 1 is further connected with a line 12 for supplying compressed air.

Figure 2:
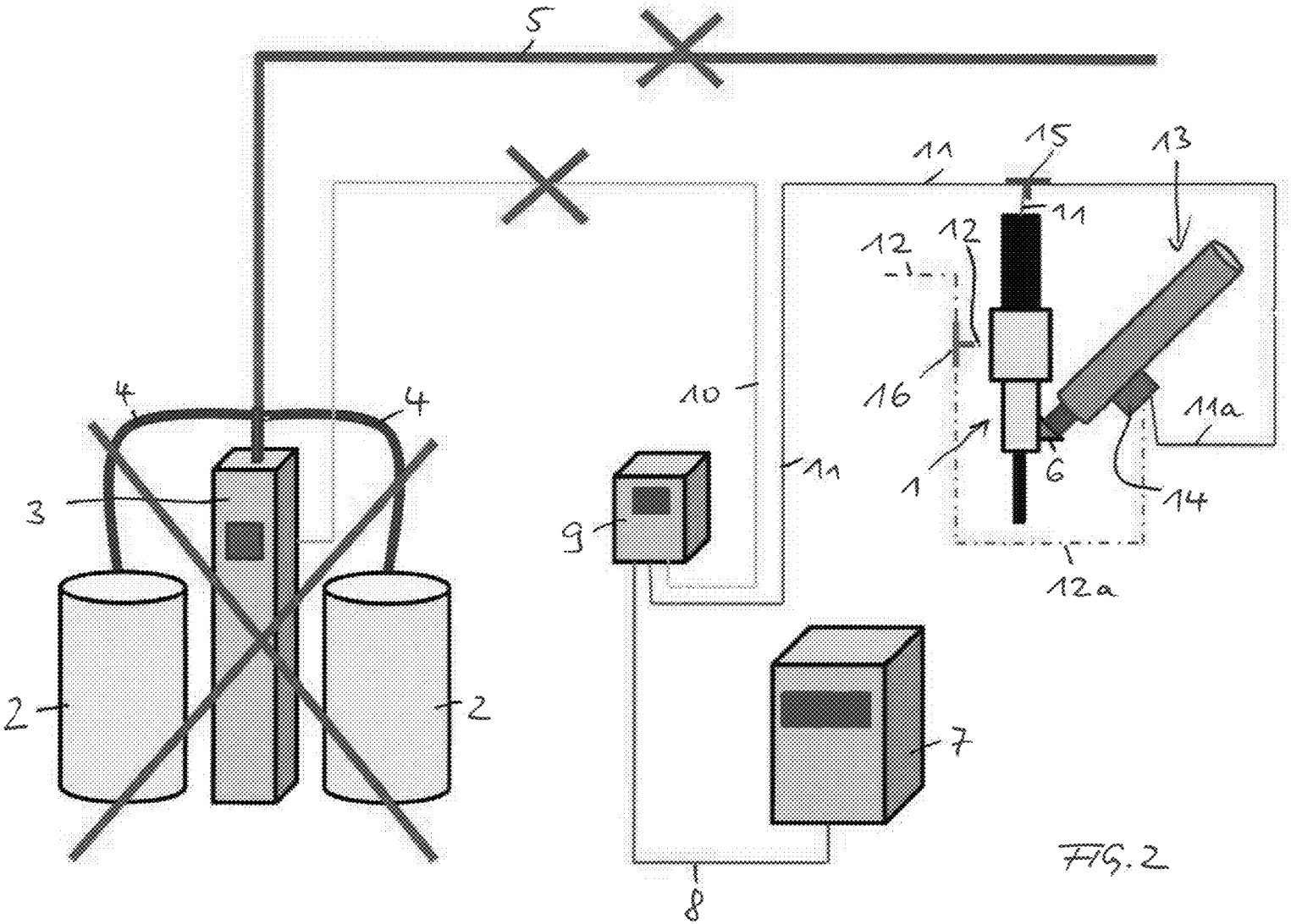
FIG. 2 is a view corresponding to FIG. 1 depicting a modification to the system according to FIG. 1 for operating the dosing feeder in the cartridge mode.

This system—herein referred to as the original system—illustrated in FIG. 1, in which the dosing feeder 1 is operated in the system mode, can be easily converted into the cartridge operating mode depicted on FIG. 2. To this end, the line 5 is detached from the dosing feeder 1, and the controller of the pump 3 is deactivated, as illustrated by the crosses recorded on FIG. 2 in the area of the pump 3 and storage containers 2, along with the line 5 and control cable 10.

The adapter 6 which had been released after separating the line 5 is connected with a cartridge 13, in particular screwed thereto. In particular, this cartridge 13 is designed as a pneumatic hand cartridge gun. For example, it can be a pneumatic hand cartridge gun from Henkel called the Power Line II. The cartridge 13 takes up the viscous medium. The cartridge 13 interacts with a pneumatic valve 14 or the cartridge 13 exhibits a pneumatic valve 14 that regulates the dispensing of medium from the cartridge 13 in the cartridge operating mode. The cartridge 13 is actuated by means of a control cable 11*a*. In the cartridge operating mode, the connection of the control cable 11 to the dosing feeder 1 is modified in such a way as to use a Y-distributor 15, wherein the control cable 11 coming from the dispensing controller 9 is guided from the Y-distributor 15 to the dosing feeder 1, and the control cable 11*a* is guided from the Y-distributor 15 to the cartridge 13 or the pneumatic valve 14. The 24 V-signal relating to "filling the dosing feeder" is transmitted via the control cable 11*a*, so that viscous medium is conveyed from the cartridge 13 into the dosing feeder 1.

Finally provided in the cartridge operating mode is a Y-distributor 16, which is allocated to the line 12 for supplying air. Air is supplied to the Y-distributor 16 via line 12, and air is supplied to the dosing feeder 1 via an outlet of the Y-distributor 16, there the continuation of line 12. Air is supplied to the pneumatic valve 14 through line 12*a* by way of the other outlet of the Y-distributor 16. Connected in parallel are the pneumatic valve 14 and a pneumatic valve of the dosing feeder 1 (not illustrated in any greater detail) that regulates the dispensing of medium from the dosing feeder 1 in the system operating mode.

As a consequence, in order to avoid having to fill the entire system prematurely, i.e., operate the dosing feeder 1 in the system mode according to FIG. 1, and thereby activate the entire system with storage containers 2 and pump 3, the cartridge 13 is instead adapted to the dosing feeder 1 in the cartridge operating mode, and the viscous medium is supplied to the dosing feeder 1 exclusively via the cartridge 13. A standardized pneumatic air cartridge gun system with a filling capacity of 330 $cm^3$, meaning a cartridge holding capacity of 330 $cm^3$, can here be used, whether heated or unheated. The cartridge 13 is mechanically joined directly with the adapter 6, and thus with the access of the dosing feeder 1. Compressed air supplied by the Y-distributor 16 permits a quick and easy connection with the cartridge 13, just as the +24 V-supply of the pneumatic valve 14 used to fill the dosing feeder 1 by way of the Y-distributor 15. After separating or deactivating the standard pump supply via the pump 3, applying the already known, existing standard signals and connections enables the use of the cartridge 13, which makes it possible to operate the system in the automatic mode, e.g., in the automatic operating mode based on the system operating mode, without requiring that the system be completely filled in the system operating mode.

Given that only a small number of vehicles are to be manufactured precisely in the development phase of a motor vehicle, the present disclosure avoids the problems caused by filling a system in the system operating mode, specifically the constant heating and cooling of the system, the low material flow of the viscous medium, and curing processes of the medium in the storage container 2, in the pump 3, in the lines 4, 5, in the adapter 6 and in the valves. The method according to the present disclosure makes it very uncomplicated to test new viscous media for a low number of vehicles to be manufactured, namely in existing production systems. The entire system here does not have to be filled and operated. Rather, the system operating mode can here indeed be converted to the cartridge operating mode within a period of 10 minutes, so that the line 5 can be separated from the dosing feeder 1, the cartridge 13 can be connected with the dosing feeder 1, and the connections with the cartridge 13 can be established by way of the line 12*a* and control cable 11*a*. The system does not have to be reprogrammed in the cartridge operating mode, since control processes take place via the dispensing controller 9 in both the system and cartridge operating modes.

While at least one exemplary embodiment was disclosed in detail above, let it be acknowledged that a plurality of inventive variations exists. Let it also be acknowledged that the at least one exemplary embodiment is merely exemplary in nature, and places no limitation on the protective scope, applications or configuration. Rather, the present disclosure is intended to serve as a convenient roadmap for implementing at least one exemplary embodiment. As a consequence, it should be acknowledged that different variations in function or arrangement can be implemented for elements of the at least one exemplary embodiment without departing from the scope prescribed by the claims and their legal equivalents.

The invention claimed is:

1. A method for operating a dosing feeder for a viscous medium comprising:

selectively operating the dosing feeder in a system mode, the medium is supplied by means of a pump from a storage container to the dosing feeder, wherein a control ler is used to supply the medium to the dosing feeder and dispense the medium from the dosing feeder; and alternately operating the dosing feeder in a cartridge operating mode, wherein the medium is supplied from a cartridge to the dosing feeder, the cartridge being separate from the storage container, and wherein the controller is used to supply the medium to the dosing feeder and dispense the medium from the dosing feeder, wherein in the cartridge operating mode, the dosing feeder is filled by means of a cartridge which is designed as a pneumatic hand spray gun.

2. The method according to claim 1, wherein the cartridge in the cartridge operating mode of the dosing feeder and a line leading from the storage container to the dosing feeder in the system operating mode are preferably connected with the same access of the dosing feeder.

3. A method for operating a dosing feeder for a viscous medium comprising:

selectively operating the dosing feeder in a system mode, the medium is supplied by means of a pump from a storage container to the dosing feeder, wherein a controller is used to supply the medium to the dosing feeder and dispense the medium from the dosing feeder; and alternately operating the dosing feeder in a cartridge operating mode, wherein the medium is supplied from a cartridge to the dosing feeder, the cartridge being separate from the storage container, and wherein the controller is used to supply the medium to the dosing feeder and dispense the medium from the dosing feeder wherein a pneumatic valve of the cartridge that regulates the dispensing of medium from the cartridge in the cartridge operating mode and a pneumatic valve of the dosing feeder that regulates the dispensing of medium from the dosing feeder in the system operating mode are connected in parallel.

4. The method according to claim 1, wherein in the system operating mode, the controller actuates the pump for conveying the medium from the storage container to the dosing feeder.

5. The method according to claim 4, wherein in the control process, a robot controller uses a field bus to control a dispensing controller, and the dispensing controller actuates the pump, dosing feeder and cartridge.

6. A method for operating a dosing feeder for a viscous medium comprising:

selectively operating the dosing feeder in a system mode, the medium is supplied by means of a pump from a storage container to the dosing feeder, wherein a controller is used to supply the medium to the dosing feeder and dispense the medium from the dosing feeder; and alternately operating the dosing feeder in a cartridge operating mode, wherein the medium is supplied from a cartridge to the dosing feeder, the cartridge being separate from the storage container, and wherein the controller is used to supply the medium to the dosing feeder and dispense the medium from e dosing feeder wherein in that a control line of the controller is connected by means of a Y-distributor with the dosing feeder and cartridge in the cartridge operating mode.

7. The method according to claim 1, wherein a pneumatic line is connected by means of a Y-distributor with the dosing feeder and cartridge in the cartridge operating mode.

* * * * *